US011436912B2

(12) United States Patent
Singh et al.

(10) Patent No.: US 11,436,912 B2
(45) Date of Patent: Sep. 6, 2022

(54) SIGNALLING DURESS

(71) Applicant: ASSA ABLOY AB, Stockholm (SE)

(72) Inventors: Sona Singh, Täby (SE); Felix Grape, Lidingö (SE)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 17/293,414

(22) PCT Filed: Nov. 19, 2019

(86) PCT No.: PCT/EP2019/081763

§ 371 (c)(1),
(2) Date: May 12, 2021

(87) PCT Pub. No.: WO2020/104439

PCT Pub. Date: May 28, 2020

(65) Prior Publication Data

US 2022/0051551 A1 Feb. 17, 2022

(30) Foreign Application Priority Data

Nov. 20, 2018 (SE) ..... 1851439-8

(51) Int. Cl.

| | |
|---|---|
| ***G08B 25/01*** | (2006.01) |
| ***G07C 9/00*** | (2020.01) |
| ***G08B 25/10*** | (2006.01) |

(52) U.S. Cl.

CPC ..... *G08B 25/016* (2013.01); *G07C 9/00309* (2013.01); *G08B 25/10* (2013.01); *G07C 2009/00507* (2013.01)

(58) Field of Classification Search

CPC ..... G06F 21/31; G06F 2221/2127; G08B 25/016; G08B 25/10; G07C 9/00309;
(Continued)

(56) References Cited

U.S. PATENT DOCUMENTS

| | | | |
|---|---|---|---|
| 9,665,705 | B2 | 5/2017 | Burke |
| 2003/0169161 | A1 | 9/2003 | Brown et al. |

(Continued)

FOREIGN PATENT DOCUMENTS

| | | |
|---|---|---|
| CN | 104100169 | 10/2014 |
| EP | 0469932 | 2/1992 |

(Continued)

OTHER PUBLICATIONS

Official Action for Sweden Patent Application No. 1851439-8, dated May 22, 2019, 8 pages.

(Continued)

*Primary Examiner* — Omeed Alizada
(74) *Attorney, Agent, or Firm* — Sheridan Ross P.C.

(57) ABSTRACT

It is provided a method performed by a key device for supporting duress signalling. The method comprises the steps of: determining that a user is under duress; entering a wait state after the step of determining that a user is under duress; exiting the wait state and establishing a communication channel with a lock device, the communication channel being intended to be used for access control signalling; generating a duress signal; and transmitting, over the communication channel, the duress signal to the lock device.

13 Claims, 4 Drawing Sheets

(58) Field of Classification Search
CPC ..... G07C 2009/00507; G07C 9/00174; G07C 2009/00555
See application file for complete search history.

(56) References Cited

U.S. PATENT DOCUMENTS

| | | | | |
|---|---|---|---|---|
| 2013/0091561 | A1* | 4/2013 | Bruso | G06F 21/31 726/16 |
| 2017/0103643 | A1* | 4/2017 | Powers, III | E05G 1/02 |
| 2017/0148241 | A1* | 5/2017 | Kerning | G08B 25/016 |
| 2018/0108196 | A1 | 4/2018 | Abner | |
| 2018/0122219 | A1 | 5/2018 | Caterino et al. | |

FOREIGN PATENT DOCUMENTS

| | | |
|---|---|---|
| EP | 1971172 | 9/2008 |
| EP | 2262292 | 12/2010 |
| EP | 2863366 | 4/2015 |

OTHER PUBLICATIONS

International Search Report and Written Opinion for International (PCT) Patent Application No. PCT/EP2019/081763, dated Feb. 7, 2020, 11 pages.
Second Written Opinion for International (PCTT) Patent Application No. PCT/EP2019/081763, dated Oct. 19, 2020, 7 pages.
International Preliminary Report on Patentability for International (PCT) Patent Application No. PCT/EP2019/081763, dated Mar. 3, 2021, 24 pages.

* cited by examiner

SIGNALLING DURESS

CROSS REFERENCE TO RELATED APPLICATIONS

This application is a national stage application under 35 U.S.C. 371 and claims the benefit of PCI Application No. PCT/EP2019/081763 having an international filing date of Nov. 19, 2019, which designated the United States, which PCT application claimed the benefit of Sweden Patent Application No. 1851439-8 filed Nov. 20, 2018, the disclosure of each of which are incorporated herein by reference.

TECHNICAL FIELD

The invention relates to a key device, a lock device, methods, computer programs and computer program products for signalling duress.

BACKGROUND

Lock devices and key devices are evolving from the traditional pure mechanical locks. These days, there are wireless interfaces for electronic lock devices, e.g. by interacting with a key device. For instance, Radio Frequency Identification (RFID), Bluetooth Low Energy (BLE) etc. can be used for the communication between lock device and key device.

However, situations of duress, i.e. threatening situations, can occur. A user can be attacked and forced to open a lock device using a key device in possession.

SUMMARY

It is an object to provide an efficient way to signal duress from a user being at risk.

According to a first aspect, it is provided a method performed by a key device for supporting duress signalling. The method comprises the steps of: determining that a user is under duress; entering a wait state after the step of determining that a user is under duress; exiting the wait state and establishing a communication channel with a lock device, the communication channel being intended to be used for access control signalling; generating a duress signal; and transmitting, over the communication channel, the duress signal to the lock device.

The step of determining that a user is under distress may comprise determining that the user is under distress unless a user input indicating non-distress is detected.

The step of exiting the wait state and establishing a communication channel may be triggered when the key device comes into communication range with the lock device.

The step of exiting the wait state and establishing a communication channel may be triggered by receiving a user input indicating that the user requests the lock device to be unlocked.

The step of determining that a user is under duress may comprise detecting a predetermined movement pattern using an accelerometer in the key device.

The step of determining that a user is under duress may comprise detecting a user interface interaction by the key device.

The step of generating the duress signal may comprise setting a duress indicator in an access control message.

According to a second aspect, it is provided a key device for supporting duress signalling. The key device comprises:

a processor; and a memory storing instructions that, when executed by the processor, cause the key device to: determine that a user is under duress; enter a wait state after the instructions to determine that a user is under duress; exit the wait state and establish a communication channel with a lock device, the communication channel being intended to be used for access control signalling; generate a duress signal; and transmit, over the communication channel, the duress signal to the lock device.

The instructions to determine that a user is under distress may comprise instructions that, when executed by the processor, cause the key device to determine that the user is under distress unless a user input indicating non-distress is detected.

The key device may further comprise instructions that, when executed by the processor, cause the key device to trigger the instructions to exit the wait state and establish a communication channel when the key device comes into communication range with the lock device.

The key device may further comprise instructions that, when executed by the processor, cause the key device to trigger the instructions to exit the wait state and establishing a communication channel when receiving a user input indicating that the user requests the lock device to be unlocked.

The instructions to determine that a user is under duress may comprise instructions that, when executed by the processor, cause the key device to detect a predetermined movement pattern using an accelerometer in the key device.

The instructions to determine that a user is under duress may comprise instructions that, when executed by the processor, cause the key device to detect a user interface interaction by the key device.

The instructions to generate the duress signal may comprise instructions that, when executed by the processor, cause the key device to set a duress indicator in an access control message.

According to a third aspect, it is provided a computer program for supporting duress signalling. The computer program comprises computer program code which, when run on a key device causes the key device to: determine that a user is under duress; enter a wait state after the computer program code is run to determine that a user is under duress; exit the wait state and establish a communication channel with a lock device, the communication channel being intended to be used for access control signalling; generate a duress signal; and transmit, over the communication channel, the duress signal to the lock device.

According to a fourth aspect, it is provided a computer program product comprising a computer program according to the third aspect and a computer readable means on which the computer program is stored.

According to a fifth aspect, it is provided a method performed by a lock device for supporting duress signalling. The method comprises the steps of: establishing a communication channel with a key device, the communication channel being intended to be used for access control signalling; receiving, over the communication channel, a duress signal from the lock device; and performing a duress action.

The duress action may comprise transmitting a duress signal to an external server, without triggering an audible alarm.

According to a sixth aspect, it is provided a lock device for supporting duress signalling, the lock device comprising: a processor; and a memory storing instructions that, when executed by the processor, cause the lock device to: establish a communication channel with a key device, the communication channel being intended to be used for access control signalling; receive, over the communication channel, a duress signal from the lock device; and perform a duress action.

The instructions to perform a duress action may comprise instructions that, when executed by the processor, cause the lock device to transmit a duress signal to an external server, without triggering an audible alarm.

According to a seventh aspect, it is provided a computer program for supporting duress signalling, the computer program comprising computer program code which, when run on a lock device causes the lock device to: establish a communication channel with a key device, the communication channel being intended to be used for access control signalling; receive, over the communication channel, a duress signal from the lock device; and perform a duress action.

According to an eighth aspect, it is provided a computer program product comprising a computer program according to the seventh aspect and a computer readable means on which the computer program is stored.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Embodiments presented herein are based on using a communication channel intended for access control communication also for signalling a duress situation.

Figure 1:
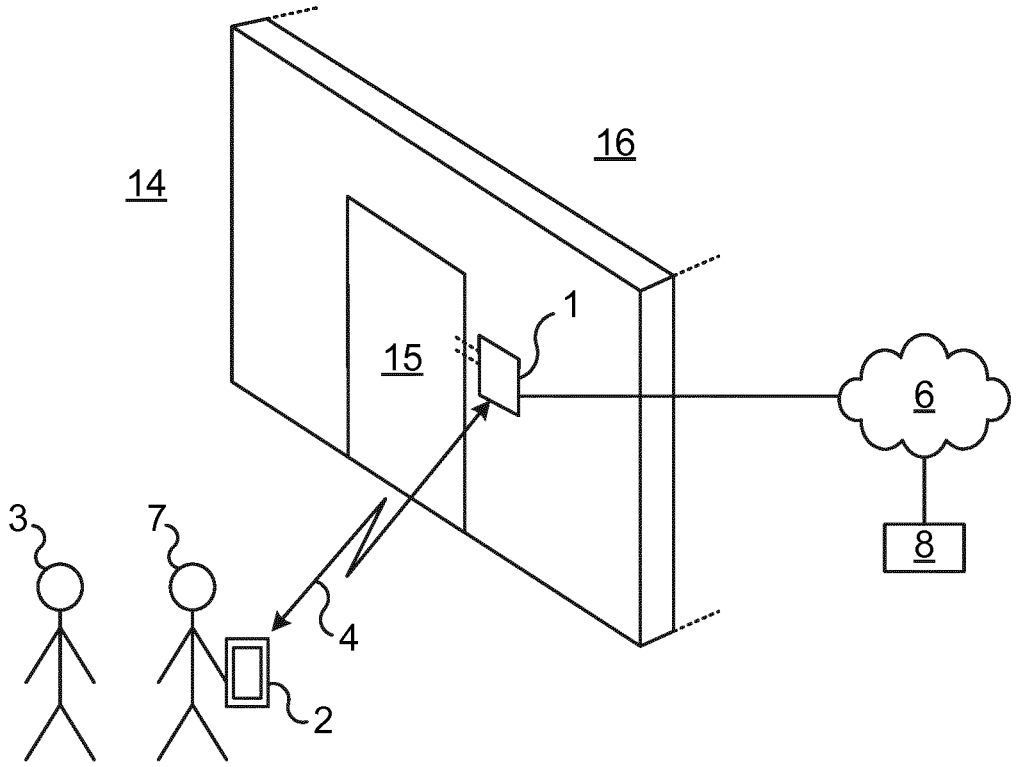
FIG. 1 is a schematic diagram showing an environment in which embodiments presented herein can be applied.

FIG. 1 is a schematic diagram showing an environment in which embodiments presented herein can be applied. Access to a physical space 16 is restricted by an openable physical barrier 15, which is selectively unlockable. The barrier 15 stands between the restricted physical space 16 on the inside of the barrier 15 and an accessible physical space 14 on the outside of the barrier 15. Note that the accessible physical space 14 can be a restricted physical space in itself, but in relation to this particular barrier 15, the accessible physical space 14 is accessible. In other words, the restricted physical space 16 is inside the barrier 15 and the accessible physical space 14 is outside the physical barrier 15. In order to unlock the barrier 15, a lock device 1 is provided. The lock device 1 is controllable to be set in an unlocked state or locked state.

The lock device 1 communicates with a key device 2 over a wireless communication channel 4. The key device 2 is any suitable device portable by a user and which can be used for authentication over the wireless communication channel 4. The key device 2 is typically carried or worn by the user 7 and may be implemented as a mobile phone, a smartphone, a key fob, wearable device, smart phone case, etc. Using wireless communication over the communication channel 4, using any suitable wireless interface, e.g. using Bluetooth or Bluetooth Low Energy (BLE), ZigBee, any of the IEEE 802.11x standards (also known as WiFi), etc., the authenticity and authority of the key device 2 can be checked in an unlock procedure. Based on the result, the lock device 1 grants or denies access. As described in more detail below, the communication between the key device 2 and the lock device 1 can be exploited for also communicating a duress signal.

The lock device 1 can also communicate with an external server 8 using a communication network 6. The communication network can e.g. form part of the Internet and/or a cellular communication network.

When access is granted, the lock device 1 is set in an unlocked state. When the lock device 1 is in an unlocked state, the barrier 15 can be opened and when the lock device 1 is in a locked state, the barrier 15 cannot be opened. In this way, access to the inside 16 of the barrier 15 is controlled by the lock device 1. It is to be noted that the lock device 1 can be mounted in a surrounding structure 17 (e.g. wall) by the physical barrier 15 (as shown) or in the physical barrier 15 (not shown).

If the user 7 is in a threatening situation, the user 7 is said to be under duress. For instance, the user 7 could be threatened by an attacker 3 to gain access to the restricted physical space 16. A problem is then how the user 7 could signal this duress while keeping safe. This is solved according to the embodiments of the method described below.

Figure 2:
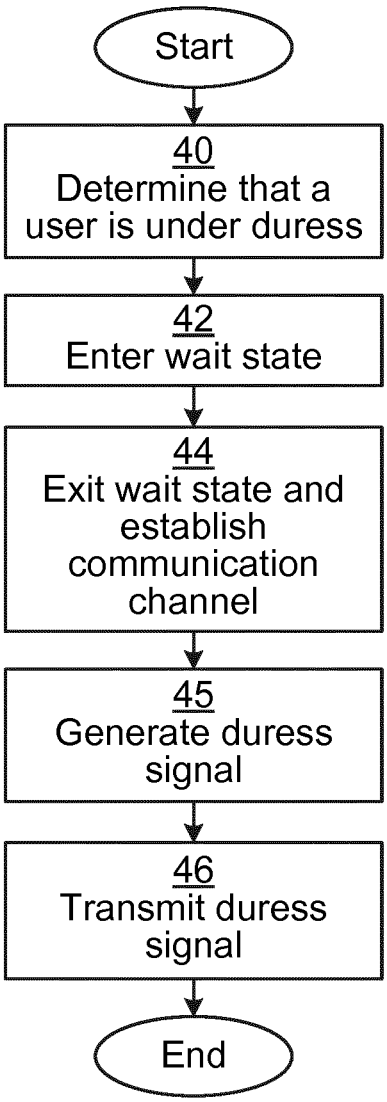
FIG. 2 is a flow chart illustrating embodiments of methods for supporting duress signalling, performed in the key device of FIG. 1.

FIG. 2 is a flow chart illustrating embodiments of methods for supporting duress signalling, performed in the key device of FIG. 1.

In a determine that a user is under duress step 40, the key device determines that a user is under duress.

In one embodiment, the user is under determined to be under distress unless a user input indicating non-distress is detected. In other words, duress is then the default situation and the user needs to perform a certain action to deactivate the duress state. In this way, if the user does not deactivate the duress, duress is assumed and appropriate further measures are taken (e.g. alarming security personnel). With this embodiment, no special signalling is needed for duress (other than the absence of duress deactivation) whereby security for the user under duress is increased, since the attacker does not know that distress is signalled.

In one embodiment, the key device determines that a user is under duress by detecting a predetermined movement pattern using an accelerometer in the key device. For instance, the user can in this way signal duress by moving the key device in a circle, or tapping the key device against a leg a predetermined number of times or using a predetermined pattern, or any other suitable predetermined movement.

Alternatively or additionally, the key device can determine that a user is under duress by detecting a user interface interaction. For instance, the user can in this way signal duress by performing a long press or hard press on a user interface element (such as a button on a touch screen or a hard key). This user interface element is optionally used for regular interaction to unlock the lock device, when the user interacts with this user interface element in a normal (i.e. not hard, long, etc.) way. In this way, it is difficult for the attacker to see that the user is signalling duress, which increases security for the user.

In an enter wait state step 42, the key device enters a wait state after it has been determined that the user is under duress. In this way, the detection of duress can occur in advance to any access control signalling with the lock device. The wait state is a state where the method waits until a trigger causes the key device to exit the wait state.

In an exit wait state and establish communication channel step 44, the key device exits the wait state and establishes a communication channel with a lock device. This step can be triggered when the key device comes into communication range with the lock device. Alternatively or additionally, this step can be triggered by receiving a user input indicating that the user requests the lock device to be unlocked. By using the wait state and only exiting the wait state when access control is triggered, the duress determination can occur in advance to requesting access, i.e. seconds or minutes prior to requesting access. In this way, when access is requested, if the user is under duress, the user does not need to do anything out of the ordinary to signal duress, which might otherwise raise suspicion with the attacker and compromise personal security for the user under duress. The communication channel is intended to be used (also) for access control signalling.

In a generate duress signal step 45, the key device generates a duress signal. The duress signal can be a separate signal or the duress signal can be a duress indicator (e.g. a flag or parameter value) in an access control message. When the duress signal is a duress indicator in the access control message, signalling is reduced. The access control message can e.g. be a message to request access or a message used in the access control procedure as known in the art per se. It is to be noted that this step can equally well be performed before step 44 or even before step 42.

In a transmit duress signal step 46, the key device transmits, over the communication channel, the duress signal to the lock device. By using the communication channel, which is used for regular access control also, existing structures are used for the duress signalling. This improves reliability of the duress signalling, since the person threatening the user of course needs the user to unlock the lock device to enter the restricted physical space. In other words, the communication channel which is necessary for unlocking the lock device is also used for signalling duress.

After, or combined with, step 46, the key device communicates with the lock device for access control signalling as known in the art per se.

For instance, the access control can be based on delegations, where, when the key device is presented for a lock device, the lock device checks that there is a valid delegation path from the lock device to the key device. The delegation path contains a plurality of chain linked delegations which starts in the lock device and ends in the key device. Each delegation is a delegation of an access right for the lock device from a delegator to a receiver. The delegation path can contain delegation(s) being locally stored by the lock device and delegation(s) communicated from the key device. The delegation path can contain an arbitrary number of delegations. Some or all delegations can be authenticated using a digital signature.

Using the delegation path, great flexibility is achieved in how access rights are provided. Since no central point of control is needed, massive scalability is achieved. Moreover, there is no single point of failure, which improves reliability.

Figure 3:
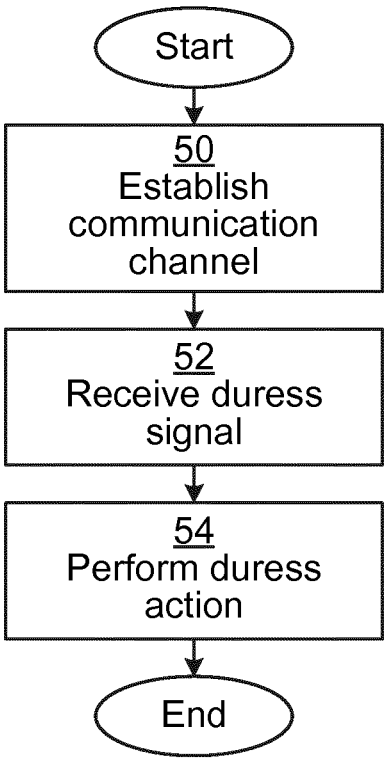
FIG. 3 is a flow chart illustrating embodiments of methods for supporting duress signalling, performed in the lock device of FIG. 1.

FIG. 3 is a flow chart illustrating embodiments of methods for supporting duress signalling, performed in the lock device of FIG. 1.

In an establish communication channel step 50, the lock device establishes a communication channel with a key device, the communication channel being intended to be used (also) for access control signalling. This step corresponds to step 44 described above.

In a receive duress signal step 52, the lock device receives, over the communication channel, a duress signal from the lock device. This step corresponds to step 46 described above.

In a perform duress action step 54, the lock device performs a duress action. The duress action can comprise transmitting a duress signal to an external server, without triggering an audible alarm. The external server can e.g. be a server of an alarm company, the employer of the user, etc. In other words, the duress action can be used to signal a threatening situation to the external server, which can trigger a response, e.g. to send someone to help the user.

Figure 4:
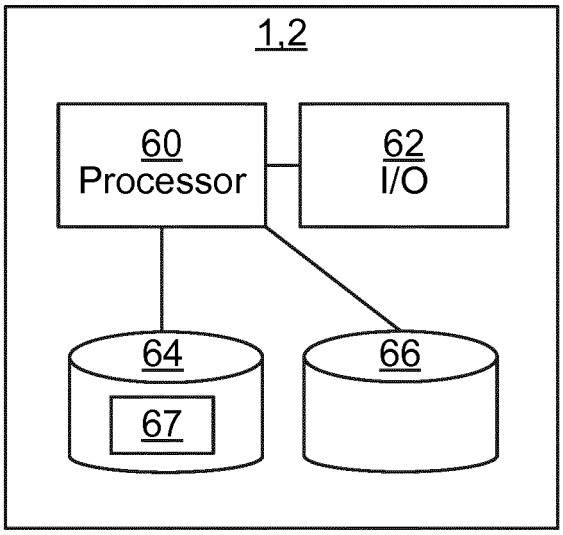
FIG. 4 is a schematic diagram illustrating components of the lock device and the key device of FIG. 1.

FIG. 4 is a schematic diagram illustrating components of the lock device 1 and the key device 2 of FIG. 1. A processor 60 is provided using any combination of one or more of a suitable central processing unit (CPU), multiprocessor, microcontroller, digital signal processor (DSP), etc., capable of executing software instructions 67 stored in a memory 64, which can thus be a computer program product. The processor 60 could alternatively be implemented using an ASIC, FPGA, etc. The processor 60 can be configured to execute the method described with reference to FIG. 2 (for the key device 2) and FIG. 3 (for the lock device 1) above.

The memory 64 can be any combination of random access memory (RAM) and/or read only memory (ROM). The memory 64 also comprises persistent storage, which, for example, can be any single one or combination of magnetic memory, optical memory, solid-state memory or even remotely mounted memory.

A data memory 66 is also provided for reading and/or storing data during execution of software instructions in the processor 60. The data memory 66 can be any combination of RAM and/or ROM.

An I/O interface 62 is provided for communicating with external and/or internal entities. Optionally, the I/O interface 62 also includes a user interface.

Other components are omitted in order not to obscure the concepts presented herein.

Figure 5:
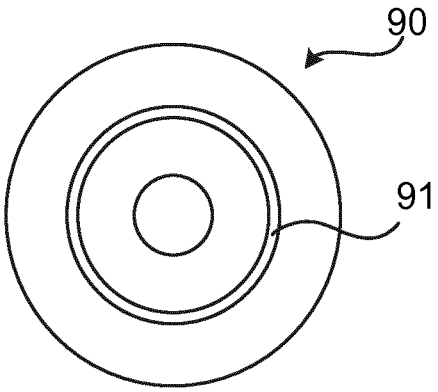
FIG. 5 shows one example of a computer program product 90 comprising computer readable means.

FIG. 5 shows one example of a computer program product 90 comprising computer readable means. On this computer readable means, a computer program 91 can be stored, which computer program can cause a processor to execute a method according to embodiments described herein. In this example, the computer program product is an optical disc, such as a CD (compact disc) or a DVD (digital versatile disc) or a Blu-Ray disc. As explained above, the computer program product could also be embodied in a memory of a device, such as the computer program product 64 of FIG. 4. While the computer program 91 is here schematically shown as a track on the depicted optical disk, the computer program can be stored in any way which is suitable for the computer program product, such as a removable solid state memory, e.g. a Universal Serial Bus (USB) drive.

Figure 6:
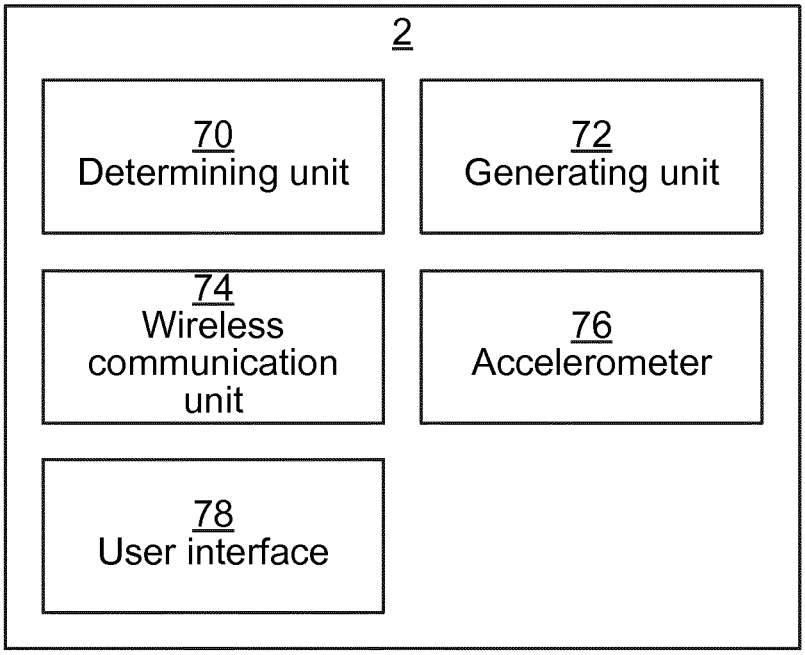
FIG. 6 is a schematic diagram illustrating units of the key device of FIG. 1 according to one embodiment.

FIG. 6 is a schematic diagram illustrating units of the key device 2 of FIG. 1 according to one embodiment. The units are implemented using circuits adapted for the functionality described herein. For instance, the units can be implemented using any one or more of an ASIC (Application Specific Integrated Circuit), an FPGA (Field Programmable Gate Array), a processor or discrete logical circuits.

A determining unit 70 is configured to determine when a user is under duress. In one embodiment, the determining unit 70 determines that a user is under duress by detecting a predetermined movement pattern using an accelerometer 78 in the key device. For instance, the user can in this way signal duress by moving the key device in a circle, or tapping the key device against a leg a predetermined number of times or using a predetermined pattern, or any other suitable predetermined movement.

Alternatively or additionally, the determining unit 70 can determine that a user is under duress by detecting a user interface interaction. For instance, the user can in this way signal duress by performing a long press or hard press on a user interface element (such as a hard key or a button on a touch screen) of a user interface 70. This user interface element is optionally used for regular interaction to unlock the lock device, when the user interacts with this user interface element in a normal (i.e. not hard, long, etc.) way. In this way, it is difficult for the attacker to see that the user is signalling duress, which increases security for the user.

A generating unit 72 is configured to generate a duress signal. The duress signal can be a separate signal or the duress signal can be a duress indicator (e.g. a flag or parameter value) in an access control message. When the duress signal is a duress indicator in the access control message, signalling is reduced. The access control message can e.g. be a message to request access or a message used in the access control procedure as known in the art per se.

A wireless communication unit 74 is configured to establish a communication channel with a lock device. The communication channel is intended to be used (also) for access control signalling. The wireless communication unit 74 can employ any suitable wireless communication standard in the communication with the lock device. For instance Bluetooth or Bluetooth Low Energy (BLE), ZigBee, any of the IEEE 802.11x standards (also known as WiFi), etc.

The wireless communication unit 74 is further configured to transmit, over the communication channel, the duress signal to the lock device. By using the communication channel, which is used for regular access control also, existing structures are used for the duress signalling. This improves reliability of the duress signalling, since the person threatening the user of course needs the user to unlock the lock device to enter the restricted physical space. In other words, the communication channel which is necessary for unlocking the lock device is also used for signalling duress.

A user interface unit 78 comprises one or more components for providing a user interface. For instance, the user interface unit 78 can comprise a display, optionally a touch screen, physical buttons, microphone, speaker, etc. The user interface unit 68 received input from the user 7 and provides output to the user 7.

The key device 2 is also configured to communicate with the lock device for access control signalling as known in the art per se. For instance, the access control can be based on delegations, where, when the key device is presented for a lock device, the lock device checks that there is a valid delegation path from the lock device to the key device. The delegation path contains a plurality of chain linked delegations which starts in the lock device and ends in the key device. Each delegation is a delegation of an access right for the lock device from a delegator to a receiver. The delegation path can contain delegation(s) being locally stored by the lock device and delegation(s) communicated from the key device. The delegation path can contain an arbitrary number of delegations. Some or all delegations can be authenticated using a digital signature.

Using the delegation path, great flexibility is achieved in how access rights are provided. Since no central point of control is needed, massive scalability is achieved. Moreover, there is no single point of failure, which improves reliability.

Other components of the key device 2 are omitted in order not to obscure the concepts presented herein.

Figure 7:
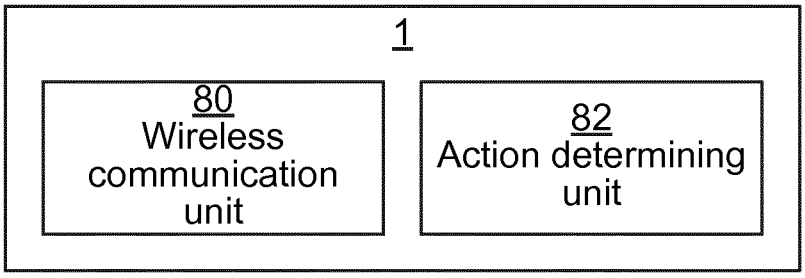
FIG. 7 is a schematic diagram illustrating units of the lock device of FIG. 1 according to one embodiment.

FIG. 7 is a schematic diagram illustrating units of the lock device 1 of FIG. 1 according to one embodiment. The units are implemented using circuits adapted for the functionality described herein. For instance, the units can be implemented using any one or more of an ASIC (Application Specific Integrated Circuit), an FPGA (Field Programmable Gate Array), a processor or discrete logical circuits.

A wireless communication unit 80 is configured to establish a communication channel with a key device, the communication channel being intended to be used (also) for access control signalling.

The wireless communication unit 80 is further configured to receive, over the communication channel, a duress signal from the lock device.

An action determining unit 82 is configured to performs a duress action when a duress signal has been received (by the wireless communication unit 80). The duress action can comprise transmitting a duress signal to an external server, without triggering an audible alarm. The external server can e.g. be a server of an alarm company, the employer of the user, etc. In other words, the duress action can be used to signal a threatening situation to the external server, which can trigger a response, e.g. to send someone to help the user.

By using the communication channel, which is used for regular access control also, existing structures are used for the duress signalling. This improves reliability of the duress signalling, since the person threatening the user of course needs the user to unlock the lock device to enter the restricted physical space. In other words, the communication channel which is necessary for unlocking the lock device is also used for signalling duress.

The lock device 1 is also configured to communicate with the key device 2 for access control signalling as known in the art per se. For instance, the access control can be based on delegations, where, when the key device is presented for a lock device, the lock device checks that there is a valid delegation path from the lock device to the key device. The delegation path contains a plurality of chain linked delegations which starts in the lock device and ends in the key device. Each delegation is a delegation of an access right for the lock device from a delegator to a receiver. The delegation path can contain delegation(s) being locally stored by the lock device and delegation(s) communicated from the key device. The delegation path can contain an arbitrary number of delegations. Some or all delegations can be authenticated using a digital signature.

Using the delegation path, great flexibility is achieved in how access rights are provided. Since no central point of control is needed, massive scalability is achieved. Moreover, there is no single point of failure, which improves reliability.

Here now follows a list of embodiments from another perspective, enumerated with roman numerals.

i. A key device for signalling duress, the key device comprising:

a determining unit configured to determine that a user is under duress;

a generating unit configured to generate a duress signal;

a wireless communication unit configured to establish a communication channel with a lock device, the communication channel being used for access control signalling; and configured to transmit, over the communication channel, the duress signal to the lock device.

ii. The key device according to embodiment i further comprising an accelerometer, and wherein the determining unit is further configured to detect a predetermined movement pattern using an accelerometer in the key device to thereby determine when a user is under duress.

iii. The key device according to embodiment i, further comprising a user interface unit, and wherein the determining unit is further configured to detect, using the user interface unit, a user interface interaction by the key device to thereby determine when a user is under duress.

iv. The key device according to embodiment i, ii, or iii, wherein the generating unit is further configured to set a duress indicator in an access control message.

v. A lock device for supporting duress signalling, the lock device comprising:

a wireless communication unit configured to establish a communication channel with a key device, the communication channel being intended to be used for access control signalling; and configured to receive, over the communication channel, a duress signal from the lock device; and an action determining unit configured to perform a duress action when a duress signal has been received.

vi. The lock device according to embodiment v, wherein the action determining unit is further configured to transmit a duress signal to an external server, without triggering an audible alarm.

vii. A method performed by a key device for supporting duress signalling, the method comprising the steps of:

determining that a user is under duress;

generating a duress signal;

establishing a communication channel with a lock device, the communication channel being intended to be used for access control signalling; and transmitting, over the communication channel, the duress signal to the lock device.

viii. The method according to embodiment vii, wherein the step of determining that a user is under duress comprises detecting a predetermined movement pattern using an accelerometer in the key device.

ix. The method according to embodiment vii, wherein the step of determining that a user is under duress comprises detecting a user interface interaction by the key device.

x. The method according to any one of the preceding embodiments, wherein the step of generating the duress signal comprises setting a duress indicator in an access control message.

xi. A key device for supporting duress signalling, the key device comprising:

a processor; and a memory storing instructions that, when executed by the processor, cause the key device to:

determine that a user is under duress;

generate a duress signal;

establish a communication channel with a lock device, the communication channel being intended to be used for access control signalling; and transmit, over the communication channel, the duress signal to the lock device.

xii. The key device according to embodiment xi, wherein the instructions to determine that a user is under duress comprise instructions that, when executed by the processor, cause the key device to detect a predetermined movement pattern using an accelerometer in the key device.

xiii. The key device according to embodiment xi, wherein the instructions to determine that a user is under duress comprise instructions that, when executed by the processor, cause the key device to detect a user interface interaction by the key device.

xiv. The key device according to any one of embodiments xi to xiii, wherein the instructions to generate the duress signal comprise instructions that, when executed by the processor, cause the key device to set a duress indicator in an access control message.

xv. A computer program for supporting duress signalling, the computer program comprising computer program code which, when run on a key device causes the key device to:

determine that a user is under duress;

generate a duress signal;

establish a communication channel with a lock device, the communication channel being intended to be used for access control signalling; and transmit, over the communication channel, the duress signal to the lock device.

xvi. A computer program product comprising a computer program according to embodiment xv and a computer readable means on which the computer program is stored.

xvii. A method performed by a lock device for supporting duress signalling, the method comprising the steps of:

establishing a communication channel with a key device, the communication channel being intended to be used for access control signalling;

receiving, over the communication channel, a duress signal from the lock device; and performing a duress action.

xviii. The method according to embodiment xvii, wherein the duress action comprises transmitting a duress signal to an external server, without triggering an audible alarm.

xix. A lock device for supporting duress signalling, the lock device comprising:

a processor; and a memory storing instructions that, when executed by the processor, cause the lock device to:

establish a communication channel with a key device, the communication channel being intended to be used for access control signalling;

receive, over the communication channel, a duress signal from the lock device; and perform a duress action.

xx. The lock device according to embodiment xix, wherein the instructions to perform a duress action comprise instructions that, when executed by the processor, cause the lock device to transmit a duress signal to an external server, without triggering an audible alarm.

xxi. A computer program for supporting duress signalling, the computer program comprising computer program code which, when run on a lock device causes the lock device to:

establish a communication channel with a key device, the communication channel being intended to be used for access control signalling;

receive, over the communication channel, a duress signal from the lock device; and perform a duress action.

xxii. A computer program product comprising a computer program according to embodiment xxi and a computer readable means on which the computer program is stored.

The invention has mainly been described above with reference to a few embodiments. However, as is readily appreciated by a person skilled in the art, other embodiments than the ones disclosed above are equally possible within the scope of the invention, as defined by the appended patent claims.

What is claimed is:

1. A method performed by a key device for supporting duress signalling, the method comprising:

determining that a user is under duress;

entering a wait state after determining that a user is under duress;

exiting the wait state and establishing a communication channel with a lock device, the communication channel being intended to be used for access control signalling;

generating a duress signal;

transmitting, over the communication channel, the duress signal to the lock device; and wherein exiting the wait state and establishing a communication channel is triggered by receiving a user input indicating that the user requests the lock device to be unlocked to gain access to a restricted physical space.

2. The method according to claim 1, wherein determining that a user is under duress comprises determining that the user is under duress unless a user input indicating non-duress is detected.

3. The method according to claim 1, wherein exiting the wait state and establishing a communication channel is triggered when the key device comes into communication range with the lock device.

4. The method according to claim 1, wherein determining that a user is under duress comprises detecting a predetermined movement pattern using an accelerometer in the key device.

5. The method according to claim 1, wherein determining that a user is under duress comprises detecting a user interface interaction by the key device.

6. The method according to claim 1, wherein generating the duress signal comprises setting a duress indicator in an access control message.

7. A key device for supporting duress signalling, the key device comprising:

a processor; and a memory storing instructions that, when executed by the processor, cause the key device to:

determine that a user is under duress;

enter a wait state after the instructions to determine that a user is under duress;

exit the wait state and establish a communication channel with a lock device, the communication channel being intended to be used for access control signalling;

generate a duress signal;

transmit, over the communication channel, the duress signal to the lock device; and trigger the instructions to exit the wait state and establishing a communication channel when receiving a user input indicating that the user requests the lock device to be unlocked.

8. The key device according to claim 7, wherein the instructions to determine that a user is under duress comprise instructions that, when executed by the processor, cause the key device to determine that the user is under duress unless a user input indicating non-duress is detected.

9. The key device according to claim 7, further comprising instructions that, when executed by the processor, cause the key device to trigger the instructions to exit the wait state and establish a communication channel when the key device comes into communication range with the lock device.

10. The key device according to claim 7, wherein the instructions to determine that a user is under duress comprise instructions that, when executed by the processor, cause the key device to detect a predetermined movement pattern using an accelerometer in the key device.

11. The key device according to claim 7, wherein the instructions to determine that a user is under duress comprise instructions that, when executed by the processor, cause the key device to detect a user interface interaction by the key device.

12. The key device according to claim 7, wherein the instructions to generate the duress signal comprise instructions that, when executed by the processor, cause the key device to set a duress indicator in an access control message.

13. A computer-readable medium comprising a computer program stored thereon for supporting duress signalling, the computer program comprising computer program code which, when run on a key device causes the key device to:

determine that a user is under duress;

enter a wait state after the computer program code is run to determine that a user is under duress;

exit the wait state and establish a communication channel with a lock device, the communication channel being intended to be used for access control signalling;

generate a duress signal;

transmit, over the communication channel, the duress signal to the lock device; and trigger the computer program code to exit the wait state and establishing a communication channel when receiving a user input indicating that the user requests the lock device to be unlocked.

* * * * *